US006107757A

United States Patent [19]

Kominami et al.

[11] Patent Number: 6,107,757

[45] Date of Patent: Aug. 22, 2000

[54] FLUORESCENT LAMP OPERATING APPARATUS

[75] Inventors: Satoshi Kominami, Katano; Kouji Miyazaki, Hirakata; Shigeru Horii, Takatsuki; Mamoru Takeda, Kyoto, all of Japan

[73] Assignee: Matsushita Electric Industrial Co., Ltd., Osaka, Japan

[21] Appl. No.: 09/164,725

[22] Filed: Oct. 1, 1998

[51] Int. Cl.[7] ..... H01J 11/04

[52] U.S. Cl. ..... 315/350; 315/176; 315/248; 315/291

[58] Field of Search ..... 315/267, 344, 315/339, 247, 337, 226, 313, 291, 176, 248

[56] References Cited

U.S. PATENT DOCUMENTS 5,239,238 8/1993 Bergervoet et al. ..... 315/248
5,747,946 5/1998 Tyler ..... 315/291

FOREIGN PATENT DOCUMENTS 62-229752 10/1987 Japan .
8-315777 11/1996 Japan .

*Primary Examiner*—Don Wong
*Assistant Examiner*—Chuc D. Tran
*Attorney, Agent, or Firm*—Ratner & Prestia

[57] ABSTRACT

A fluorescent lamp operating apparatus is used for operating a fluorescent lamp, which includes a glass tube coated with a phosphor and has at least mercury sealed therein, by generating an electric field in a direction from an inner surface of the glass tube toward a center of the glass tube. The operating apparatus, for example, includes: a ballast circuit connected to the fluorescent lamp for starting the fluorescent lamp; a potential application member disposed so as to at least partially surround discharge plasma generated in the fluorescent lamp; and a potential application circuit for applying a potential to the potential application member. In such a case, the potential application circuit applies a potential to the potential application member which is higher than the potential of the discharge plasma.

13 Claims, 12 Drawing Sheets

FLUORESCENT LAMP OPERATING APPARATUS

BACKGROUND OF THE INVENTION

1. Field of the Invention

The present invention relates to a fluorescent lamp operating apparatus capable of improving a lumen maintenance factor by suppressing the reaction between mercury and both of a phosphor and a glass tube, and thus extending life of a fluorescent lamp. The present invention also relates to a fluorescent lamp operating apparatus capable of improving the lumen maintenance factor and thus enhancing the start-up characteristic of a fluorescent lamp.

2. Description of the Related Art

FIG. 10 is a schematic view of a conventional fluorescent lamp operating apparatus 1000.

The fluorescent lamp operating apparatus 1000 in FIG. 10 includes a fluorescent lamp 101 and a ballast circuit 102 for starting the fluorescent lamp 101. In this specification, the expression "starting the lamp" means to start the lightening of the lamp (i.e., to ignite the lamp).

The ballast circuit 102 includes a DC power supply circuit 103, an inverter circuit 104, a choke coil 111, and a capacitor 112. The DC power supply circuit 103 rectifies and smooths a commercial AC power supply 105 by a rectifier 106 and a capacitor 107 so as to convert an AC current to a DC current.

The inverter circuit 104 includes transistors 108 and 109, a capacitor 110, and a driving circuit 113. The transistors 108 and 109 are turned ON or OFF alternately by a signal from the driving circuit 113. When the transistor 108 is ON and the transistor 109 is OFF, a current flows in a path beginning at the capacitor 107 and continues in the order of the transistor 108, the capacitor 110, the choke coil 111, the fluorescent lamp 101, and the capacitor 107. When the transistor 108 is OFF and the transistor 109 is ON, a current flows in a path beginning at the capacitor 110 and continues in the order of the transistor 109, the fluorescent lamp 101, the choke coil 111, and the capacitor 110. Thus, an output from the DC power supply circuit 103 is converted into an AC current of several tens of kilohertz.

The fluorescent lamp 101 has a structure shown in FIGS. 11A and 11B. FIG. 11A is a cross-sectional view of the fluorescent lamp 101 along a longitudinal axis thereof, and FIG. 11B is a cross-sectional view of the fluorescent lamp 101 in a radial direction thereof.

Specifically, the fluorescent lamp 101 has the following structure. Electrodes 116 and 117 are respectively sealed at both ends of a glass tube 114 coated with a phosphor 115. In the glass tube 114, mercury and filling gas, such as argon and the like, for lowering the breakdown voltage at the start of operation by the Penning effect are sealed.

The fluorescent lamp operating apparatus 1000 having the above-described structure operates in, for example, the following manner.

When the power supply is turned ON, a preheating current flows in a path beginning at the inverter circuit 104 and continues in the order of the choke coil 111, the electrode 116, the capacitor 112, the electrode 117 and the inverter circuit 104. Moreover, a high voltage is applied to the fluorescent lamp 101 by resonance of both of the capacitors 110 and 112 and the choke coil 111. When the electrodes 116 and 117 are sufficiently heated by the preheating current, breakdown occurs and discharge plasma is formed in the glass tube 114 so as to start discharge. Due to the discharge, the mercury sealed in the glass tube 114 radiates ultraviolet rays mainly having a wavelength of 254 nm, and the ultraviolet rays excite the phosphor 115 applied on the glass tube 114, thereby causing the phosphor 115 to generate visible light. After this, the fluorescent lamp 101 maintains its operation by the AC power supplied from the inverter 104.

In such a fluorescent lamp 101, the lumen flux generally is reduced over the period in which the fluorescent lamp is operated. There are various causes for such a phenomenon. Main causes include (1) the reaction between the phosphor 115 and mercury ions, i.e., deterioration of the phosphor 115 by the mercury ions being adsorbed to the phosphor 115; and (2) reduction in the radiation amount of ultraviolet rays having a wavelength of 254 nm which is caused by the amount of mercury in the discharge space being reduced as a result of the reaction between the glass tube 114 and the mercury ions which form the fluorescent lamp 101.

As a solution of this problem, Japanese Laid-Open Publication No. 62-229752 discloses a method of forming a metal oxide protective film on a phosphor layer which is applied on the glass tube and thus suppressing the reaction between mercury and both of the phosphor and the glass tube. Another method of providing a protective film formed of alumina or the like between the glass tube and the phosphor layer and thus preventing the reaction between mercury and the glass tube has been proposed.

The fluorescent lamps obtained in these manners require a high voltage to be applied thereto at the start of operation. Accordingly, it has been proposed to provide the glass tube with a conductive film as a start assistance device. A fluorescent lamp having such a structure is referred to as a rapid-start fluorescent lamp.

The above-described fluorescent lamps have the following problems.

For example, in the case of the conventional fluorescent lamp 1000 described above, when the transistor 108 is ON and the transistor 109 is OFF, the current flows in the order of the DC power supply circuit 103, the transistor 108, the capacitor 110, the choke coil 111, the fluorescent lamp 101 and the DC power supply circuit 103. Since the output from the DC power supply circuit 103 is positive, the potential of the discharge plasma generated in the glass tube 114 is positive. Therefore, an electric field is generated in the glass tube 114 in a direction toward an infinite ground potential point (in a direction shown by the arrows in FIG. 11, i.e., from the center of the glass tube 114 toward the inner surface of the glass tube 114). The mercury ions, which are positive ions, receive the force toward the inner surface of the glass tube 114 by the electric field. As a result, as shown in FIG. 12, the mercury ion density is lower at the center of the glass tube 114 than in the vicinity of the inner surface thereof. Accordingly, the reaction between the mercury ions and both of the phosphor and the glass tube is accelerated, thereby reducing the amount of mercury contributable to light emission. In consequence, the life of the fluorescent lamp 101 is adversely effected.

The method disclosed in Japanese Laid-Open Publication No. 62-229752 cannot solve this problem for the following reason. It is difficult to apply a protective film having a uniform thickness on the phosphor, and therefore the mercury ions react with the phosphor and the glass tube in a portion of the protective film having a lesser thickness. Thus, the reaction cannot be suppressed sufficiently.

The rapid-start fluorescent lamp improves the start-up characteristic by lowering the breakdown voltage through formation of a conductive film, but is not effective on extension of life of the fluorescent lamp.

SUMMARY OF THE INVENTION

A fluorescent lamp operating apparatus of the present invention is used for operating a fluorescent lamp, which includes a glass tube coated with a phosphor and has at least mercury sealed therein, by generating an electric field in a direction from an inner surface of the glass tube toward a center of the glass tube.

The fluorescent lamp operating apparatus may include: a ballast circuit connected to the fluorescent lamp for starting the fluorescent lamp; a potential application member disposed so as to at least partially surround discharge plasma generated in the fluorescent lamp; and a potential application circuit for applying a potential to the potential application member. In such a case, the potential application circuit applies a potential to the potential application member which is higher than the potential of the discharge plasma.

The potential application circuit may be included in the ballast circuit.

The ballast circuit may include a DC power supply circuit for supplying a power to the fluorescent lamp and applying a potential to the potential application member.

The potential application member may be provided in the glass tube.

Alternatively, the potential application member may be a thin film provided on the glass tube. The thin film may be light-transmissive. Furthermore, the thin film may be striped or spiral.

In addition, the potential application member may be conductive. In such a case, a potential which is higher than the potential of the discharge plasma may be applied to the potential application member at least in a period in which the fluorescent lamp is in a rated operating condition.

The fluorescent lamp operating apparatus may further include a switching device for controlling the application of the potential to the potential application member. In one embodiment, the switching device is turned ON while the fluorescent lamp is in a starting period and turned OFF while the fluorescent lamp is in a rated operating condition.

Thus, the invention described herein makes possible the advantages of (1) providing a fluorescent lamp operating apparatus capable of improving a lumen maintenance factor by suppressing the reaction between mercury and both of a phosphor and a glass tube and the loss of mercury ions, and thus extending the life of a fluorescent lamp; and (2) providing a fluorescent lamp operating apparatus capable of improving the lumen maintenance factor and enhancing the start-up characteristic of a fluorescent lamp.

These and other advantages of the present invention will become apparent to those skilled in the art upon reading and understanding the following detailed description with reference to the accompanying figures.

DESCRIPTION OF THE PREFERRED EMBODIMENTS

Hereinafter, the present invention will be described by way of illustrative examples with reference to the accompanying drawings.

EXAMPLE 1

Figure 1:
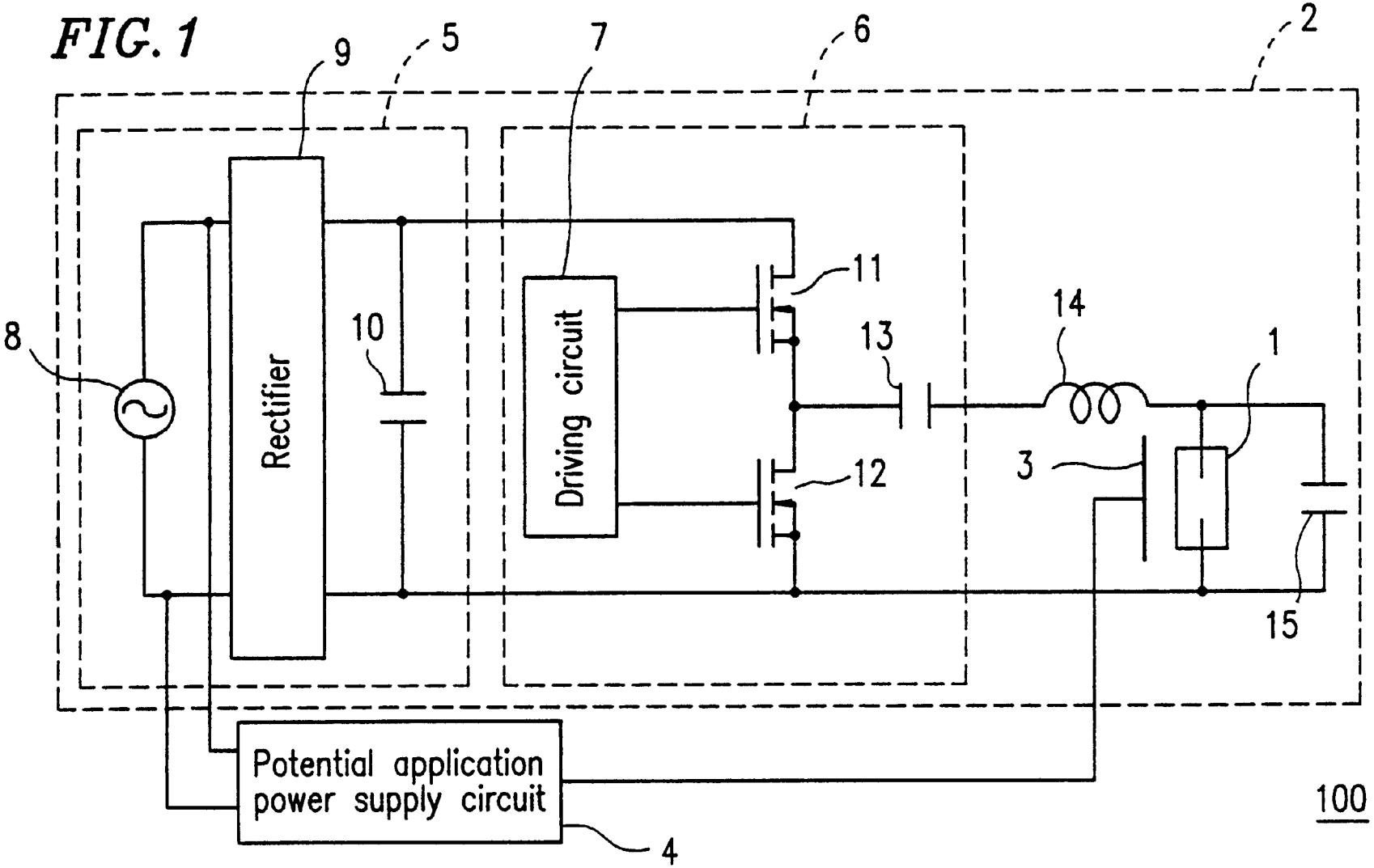
FIG. 1 is a schematic view of a fluorescent lamp operating apparatus in a first example according to the present invention.

FIG. 1 is a schematic view of a fluorescent lamp operating apparatus 100 in a first example according to the present invention.

The fluorescent lamp operating apparatus 100 in FIG. 1 includes a fluorescent lamp 1, a ballast circuit 2 for starting the fluorescent lamp 1, a thin light-transmissive conductive film 3 acting as a potential application member disposed so as to enclose discharge plasma generated in the fluorescent lamp 1, and a potential application power supply circuit 4 (also simply referred to as a "potential application circuit") for applying a potential which is higher than that of the discharge plasma to the light-transmissive conductive film 3.

The ballast circuit 2 includes a DC power supply circuit 5, an inverter circuit 6, a choke coil 14, and a capacitor 15. The DC power supply circuit 5 rectifies and smooths a commercial AC power supply 8 by a rectifier 9 and a capacitor 10 so as to convert an AC current to a DC current.

The inverter circuit 6 includes transistors 11 and 12, a capacitor 13, and a driving circuit 7. The transistors 11 and 12 are turned ON or OFF alternately by a signal from the driving circuit 7. When the transistor 11 is ON and the transistor 12 is OFF, a current flows in a path beginning at the capacitor 10 and continues in the order of the transistor 11, the capacitor 13, the choke coil 14, the fluorescent lamp 1, and the capacitor 10. When the transistor 11 is OFF and the transistor 12 is ON, a current flows in a path beginning at the capacitor 13 and continues in the order of the transistor 12, the fluorescent lamp 1, the choke coil 14, and the capacitor 13. Thus, an output from the DC power supply circuit 5 is converted into an AC current of several tens of kilohertz.

The potential application circuit 4 is satisfactory as long as generating a potential which is higher than that of the discharge plasma generated in the fluorescent lamp 1. Such a high potential can be easily output by, for example, providing a voltage doubler rectifier using the commercial AC power supply 8.

Figures 2A, 2B:
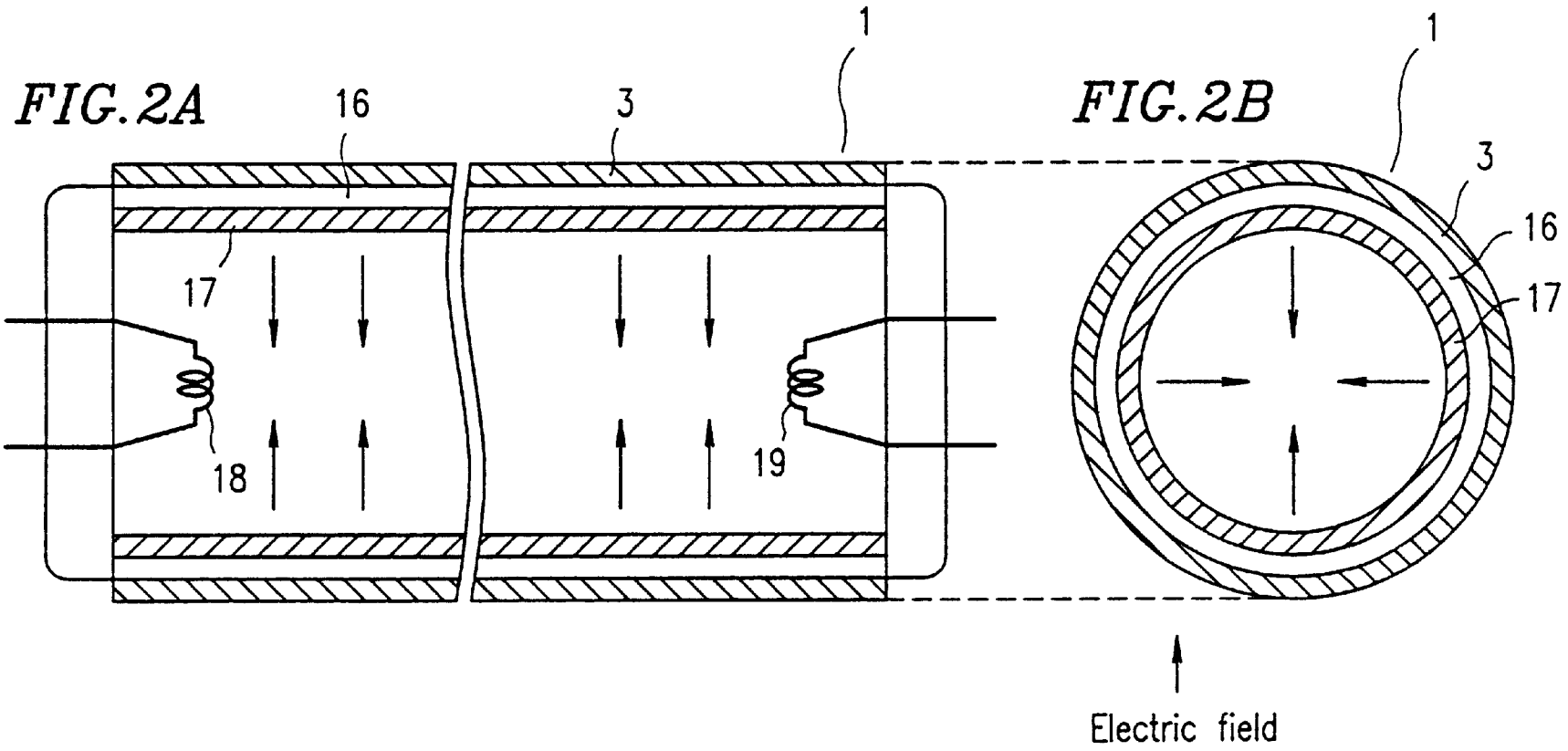
FIG. 2A is a cross-sectional view of the fluorescent lamp of the fluorescent lamp operating apparatus shown in FIG. 1 along a longitudinal axis thereof.
FIG. 2B is a cross-sectional view of the fluorescent lamp shown in FIG. 1 in a radial direction thereof.

The fluorescent lamp 1 has a structure shown in FIGS. 2A and 2B. FIG. 2A is a cross-sectional view of the fluorescent lamp 1 along a longitudinal axis thereof, and FIG. 2B is a cross-sectional view of the fluorescent lamp 1 in a radial direction thereof.

Specifically, the fluorescent lamp 1 has the following structure. Electrodes 18 and 19 are respectively sealed at both ends of a glass tube 16. In the glass tube 16, at least mercury, and preferably mercury and filling gas such as argon and the like, for lowering the breakdown voltage at the start of operation by the Penning effect are sealed. A phosphor layer 17 is provided on an inner surface of the glass tube 16, and a light-transmissive conductive film 3 is provided on an outer surface of the glass tube 16. The light-transmissive conductive film 3 is provided on substantially the entire outer surface of the glass tube 16 so as to enclose the discharge plasma generated in the glass tube 16. The light-transmissive conductive film 3 is connected to the potential application circuit 4 and is maintained at the output potential of the potential application circuit 4.

The fluorescent lamp operating apparatus 100 having the above-described structure operates in, for example, the following manner.

When the power supply is turned ON, a preheating current flows in a path beginning at the inverter circuit 6 and continues in the order of the choke coil 14, the electrode 18, the capacitor 15, the electrode 19 and the inverter circuit 6. Moreover, a high voltage is applied to the fluorescent lamp 1 by resonance of both of the capacitors 13 and 15 and the choke coil 14. When the electrodes 18 and 19 are sufficiently heated by the preheating current, breakdown occurs and a discharge plasma is formed in the glass tube 16 so as to start discharge.

Due to the discharge, the mercury sealed in the glass tube 16 radiates ultraviolet rays mainly having a wavelength of 254 nm, and the ultraviolet rays excite the phosphor layer 17 applied on the glass tube 16, thereby causing the phosphor layer 17 to generate visible light. After this, the fluorescent lamp 1 maintains its operation by the AC power supplied from the inverter 16.

Figure 3:
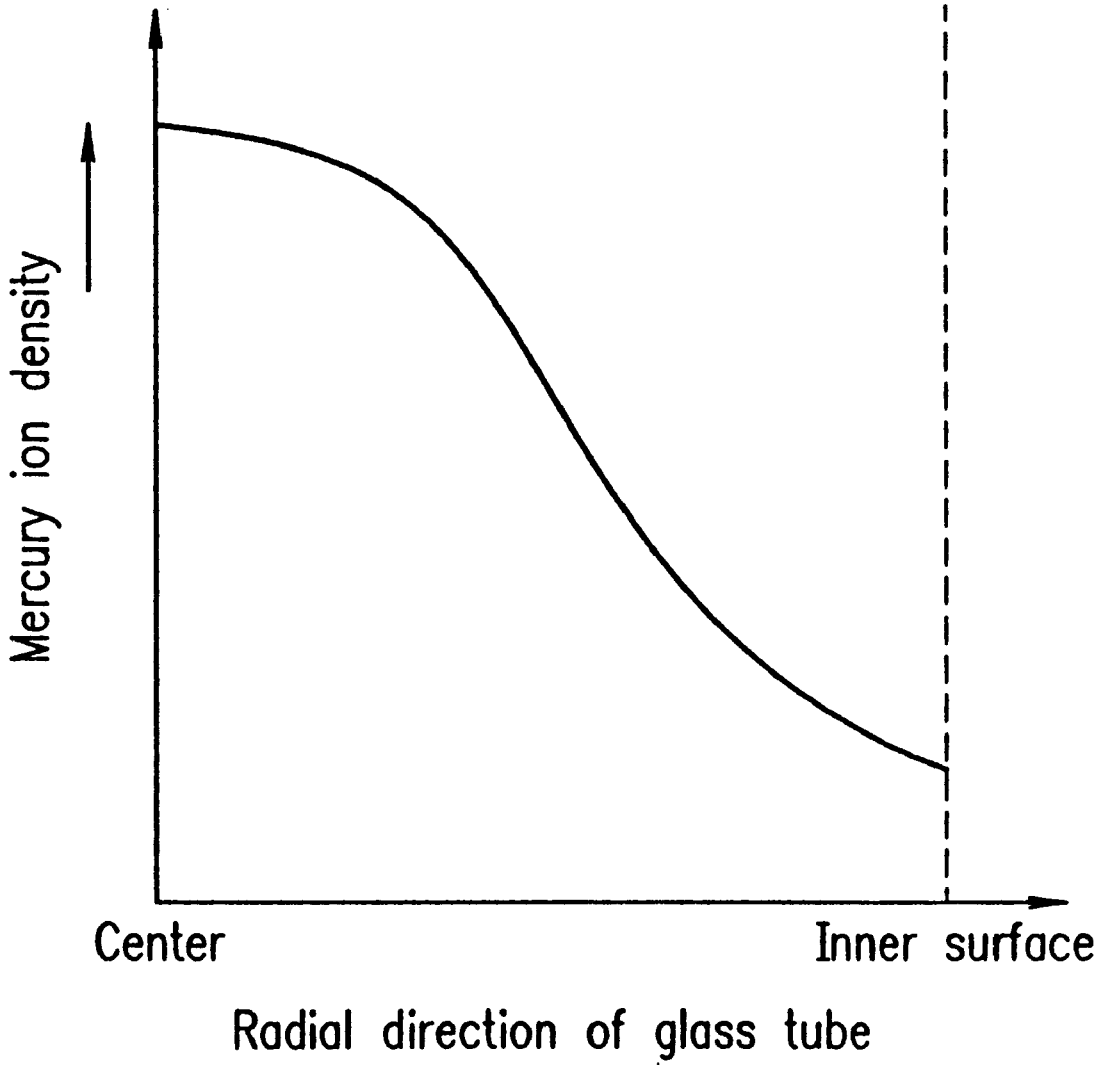
FIG. 3 is a graph illustrating distribution of mercury ion density in a radial direction of a glass tube of the fluorescent lamp shown in FIG. 1 in the first example.

The potential application circuit 4 is configured to output a potential higher than that of the discharge plasma, and thus the light-transmissive conductive film 3 connected to the potential application circuit 4 has a potential higher than that of the discharge plasma. Therefore, an electric field is generated in the glass tube 16 in a direction from the light-transmissive conductive film 3 toward the discharge plasma (in a direction shown by the arrows in FIG. 2, i.e., from the inner surface of the glass tube 16 toward the center of the glass tube 16). The mercury ions, which are positive ions, receive the force toward the center of the glass tube 16 by the electric field. As a result, as shown in FIG. 3, the mercury ion density is higher at the center of the glass tube 16 than in the vicinity of the inner surface thereof. Accordingly, the reaction between the mercury ions and both of the phosphor layer 17 and the glass tube 16 is suppressed, thereby restricting the deterioration of the phosphor layer 17 and the loss of the mercury.

As described above, the fluorescent lamp operating apparatus 100 in the first example according to the present invention includes the fluorescent lamp 1, the ballast circuit 2 for starting the fluorescent lamp 1, the light-transmissive conductive film 3 acting as a potential application member disposed so as to enclose the discharge plasma generated in the fluorescent lamp 1, and the potential application circuit 4 for applying a potential to the light-transmissive conductive film 3 which is higher than that of the discharge plasma. In such a structure, the mercury ion density in the vicinity of the inner surface of the glass tube 16 can be lower than at the center of the glass tube 16 by connecting the potential application circuit 4 and the light-transmissive conductive film 3 to each other and thus raising the potential of the light-transmissive conductive film 3 to a level higher than that of the discharge plasma. Thus, the reaction between the mercury and both of the phosphor layer 17 and the glass tube 16 is suppressed. In this manner, the lumen maintenance factor is improved and the life of the fluorescent lamp 1 is extended by preventing the deterioration of the phosphor layer 17 and the loss of mercury without using the protective film as is required in the conventional operating apparatuses.

EXAMPLE 2

Figure 4:
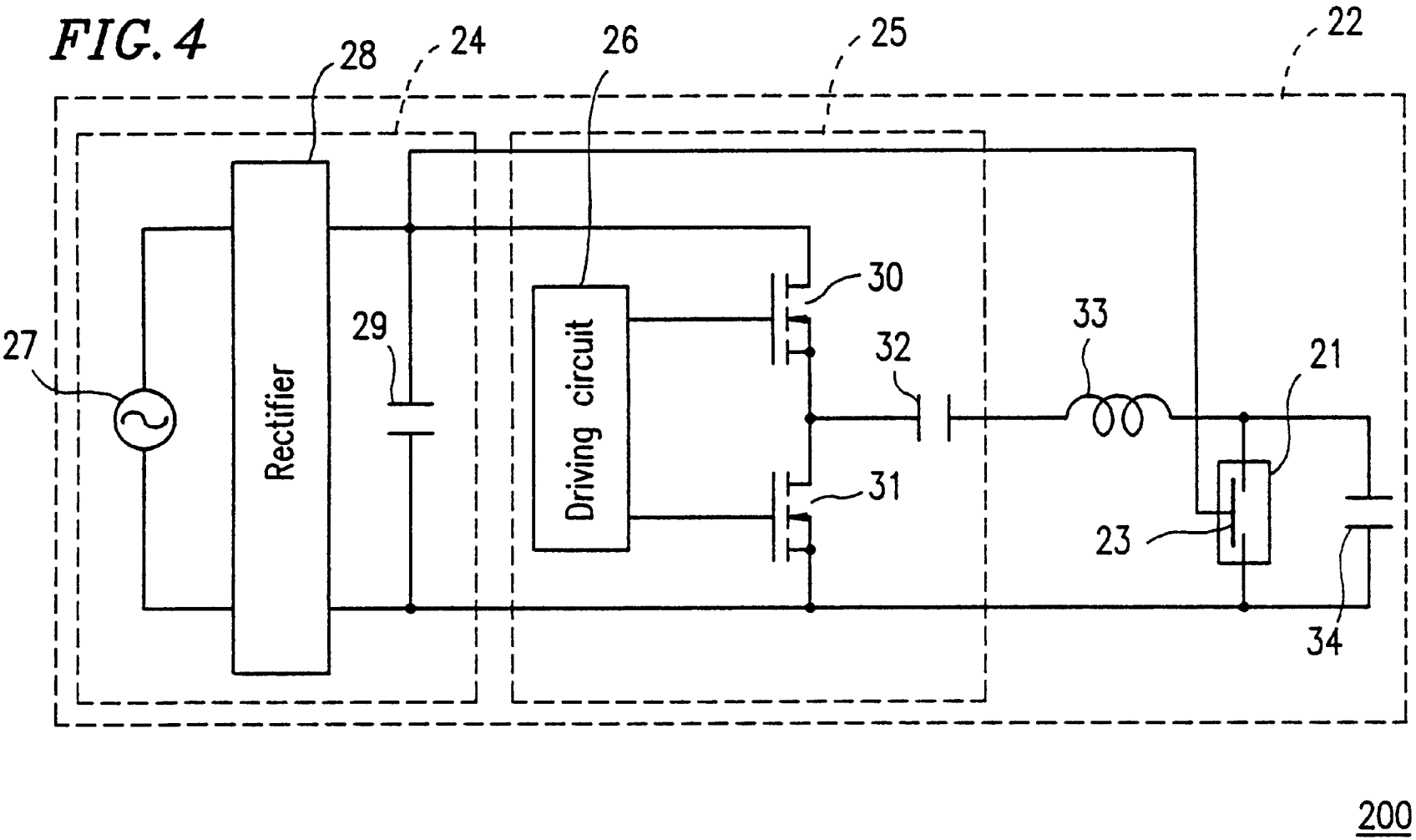
FIG. 4 is a schematic view of a fluorescent lamp operating apparatus in a second example according to the present invention.

FIG. 4 is a schematic view of a fluorescent lamp operating apparatus 200 in a second example according to the present invention.

The fluorescent lamp operating apparatus 200 in FIG. 4 includes a fluorescent lamp 21, a ballast circuit 22 for starting the fluorescent lamp 21, a thin light-transmissive conductive film 23 acting as a potential application member disposed so as to enclose discharge plasma generated in the fluorescent lamp 21.

The ballast circuit 22 includes a DC power supply circuit 24, an inverter circuit 25, a choke coil 33, and a capacitor 34. The DC power supply circuit 24 rectifies and smooths a commercial AC power supply 27 by a rectifier 28 and a capacitor 29 so as to convert an AC current to a DC current.

The inverter circuit 25 includes transistors 30 and 31, a capacitor 32, and a driving circuit 26. The transistors 30 and 31 are turned ON or OFF alternately by a signal from the driving circuit 26. When the transistor 30 is ON and the transistor 31 is OFF, a current flows in a path beginning at the capacitor 29 and continues in the order of the transistor 30, the capacitor 32, the choke coil 33, the fluorescent lamp 21, and the capacitor 29. When the transistor 30 is OFF and the transistor 31 is ON, a current flows in a path beginning at the capacitor 32 and continues in the order of the transistor 31, the fluorescent lamp 21, the choke coil 33, and the capacitor 32. Thus, an output from the DC power supply circuit 24 is converted into an AC current of several tens of kilohertz.

Figures 5A, 5B:
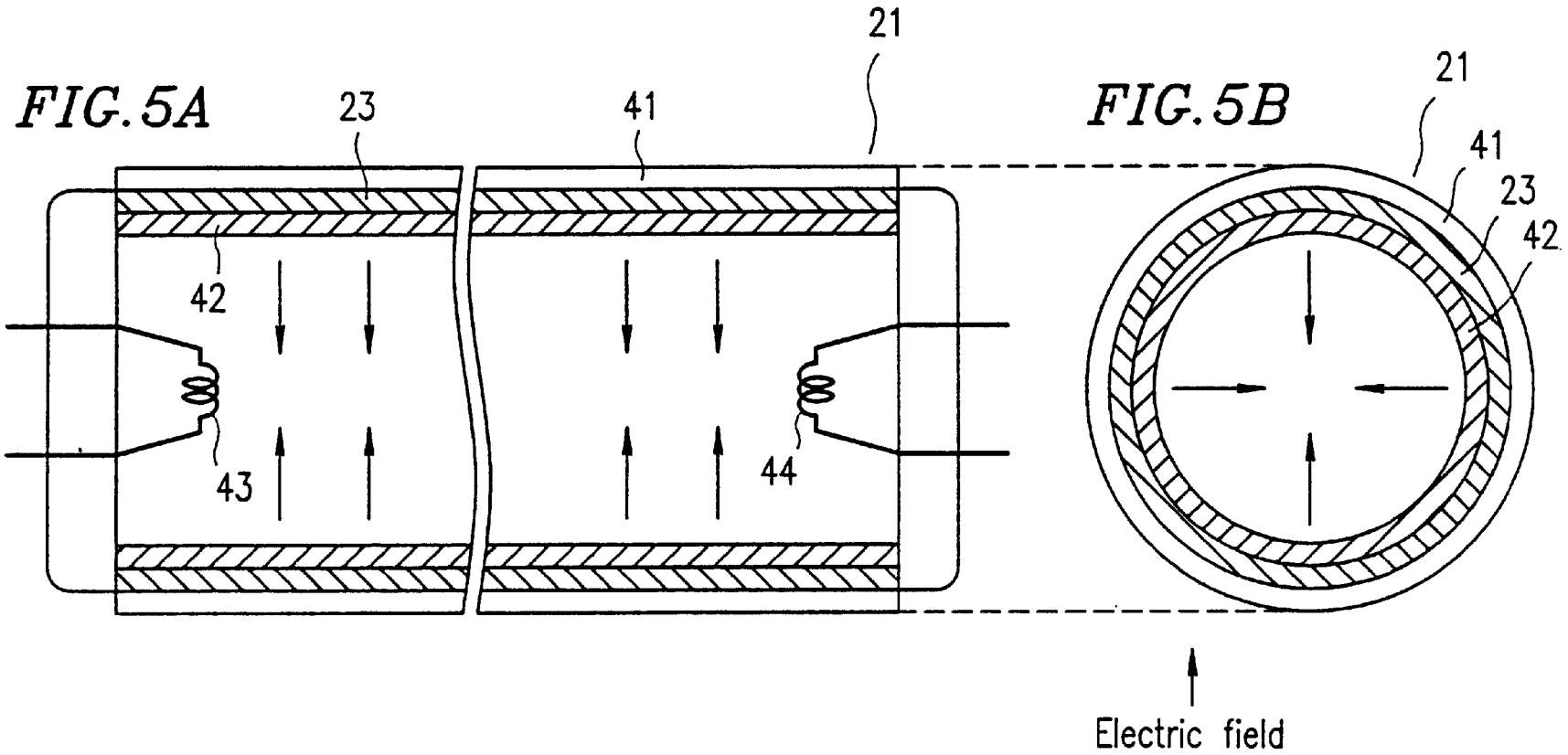
FIG. 5A is a cross-sectional view of the fluorescent lamp shown in FIG. 4 along a longitudinal axis thereof.
FIG. 5B is a cross-sectional view of the fluorescent lamp of the fluorescent lamp operating apparatus shown in FIG. 4 in a radial direction thereof.

The fluorescent lamp 21 has a structure shown in FIGS. 5A and 5B. FIG. 5A is a cross-sectional view of the fluorescent lamp 21 along a longitudinal axis thereof, and FIG. 5B is a cross-sectional view of the fluorescent lamp 21 in a radial direction thereof.

Specifically, the fluorescent lamp 21 has the following structure. Electrodes 43 and 44 are respectively sealed at both ends of a glass tube 41. In the glass tube 41, at least mercury, and preferably mercury and filling gas, such as argon and the like, for lowering the breakdown voltage at the start of operation by the Penning effect are sealed. A light-transmissive conductive film 23 and a phosphor layer 42 are provided on an inner surface of the glass tube 41. The light-transmissive conductive film 23 is provided so as to enclose the discharge plasma generated in the glass tube 41. The light-transmissive conductive film 23 is connected to a high potential output of the DC power supply circuit 24 and is maintained at the output potential of the DC power supply circuit 24.

The fluorescent lamp operating apparatus 200 having the above-described structure operates in, for example, the following manner. Since the operation for starting the fluorescent lamp 21 is identical with that of the fluorescent lamp operating apparatus 100 in the first example, the following explanation will be regarding the operation of the fluorescent lamp operating apparatus 200 after the fluorescent lamp 21 is started.

Where the output potential of the high potential output of the DC power supply circuit 24 when the fluorescent lamp 21 is operated is $V_1$ (>0), the potential of the discharge plasma generated in the glass tube 41 is $V_1$ or less, and the potential of the light-transmissive conductive film 23 connected to the high potential output of the DC power supply circuit 24 is $V_1$. Therefore, an electric field is generated in the glass tube 41 in a direction from the light-transmissive conductive film 23 toward the discharge plasma (in a direction shown by the arrows in FIG. 5, i.e., from the inner surface of the glass tube 41 toward the center of the glass tube 41). Due to the action of the electric field, the mercury ion density in the glass tube 41 is distributed in the same manner as described as in the first example with reference to FIG. 3. Accordingly, the reaction between the mercury ions and both of the phosphor layer 42 and the glass tube 41 is suppressed, thereby restricting the deterioration of the phosphor layer 42 and the loss of the mercury.

As described above, the fluorescent lamp operating apparatus 200 in the second example according to the present invention includes the fluorescent lamp 21, the ballast circuit 22 for starting the fluorescent lamp 21, and the light-transmissive conductive film 23 acting as a potential application member disposed so as to enclose the discharge plasma generated in the fluorescent lamp 21. The high potential output of the DC power supply circuit 24 of the ballast circuit 22 and the light-transmissive conductive film 23 are connected to each other, thereby raising the potential of the light-transmissive conductive film 23 to a level higher than that of the discharge plasma. Thus, the mercury ion density is made lower in the vicinity of the inner surface of the glass tube 41 than at the center of the glass tube 41, thereby suppressing the reaction between the mercury and both of the phosphor layer 42 and the glass tube 41. In this manner, the lumen maintenance factor is improved and the life of the fluorescent lamp 21 is extended by preventing the deterioration of the phosphor layer 42 and the loss of mercury without using the protective film as is required in the conventional operating apparatuses.

Since a potential at the high potential output of the DC power supply circuit 24 is applied to the light-transmissive conductive film 23, the life of the fluorescent lamp 21 is extended by a simpler structure than in the first example. Since the light-transmissive conductive film 23 is provided inside the glass tube 41, operators are protected against contact with the light-transmissive conductive film 23 supplied with a high potential, providing higher safety.

EXAMPLE 3

Figure 6:
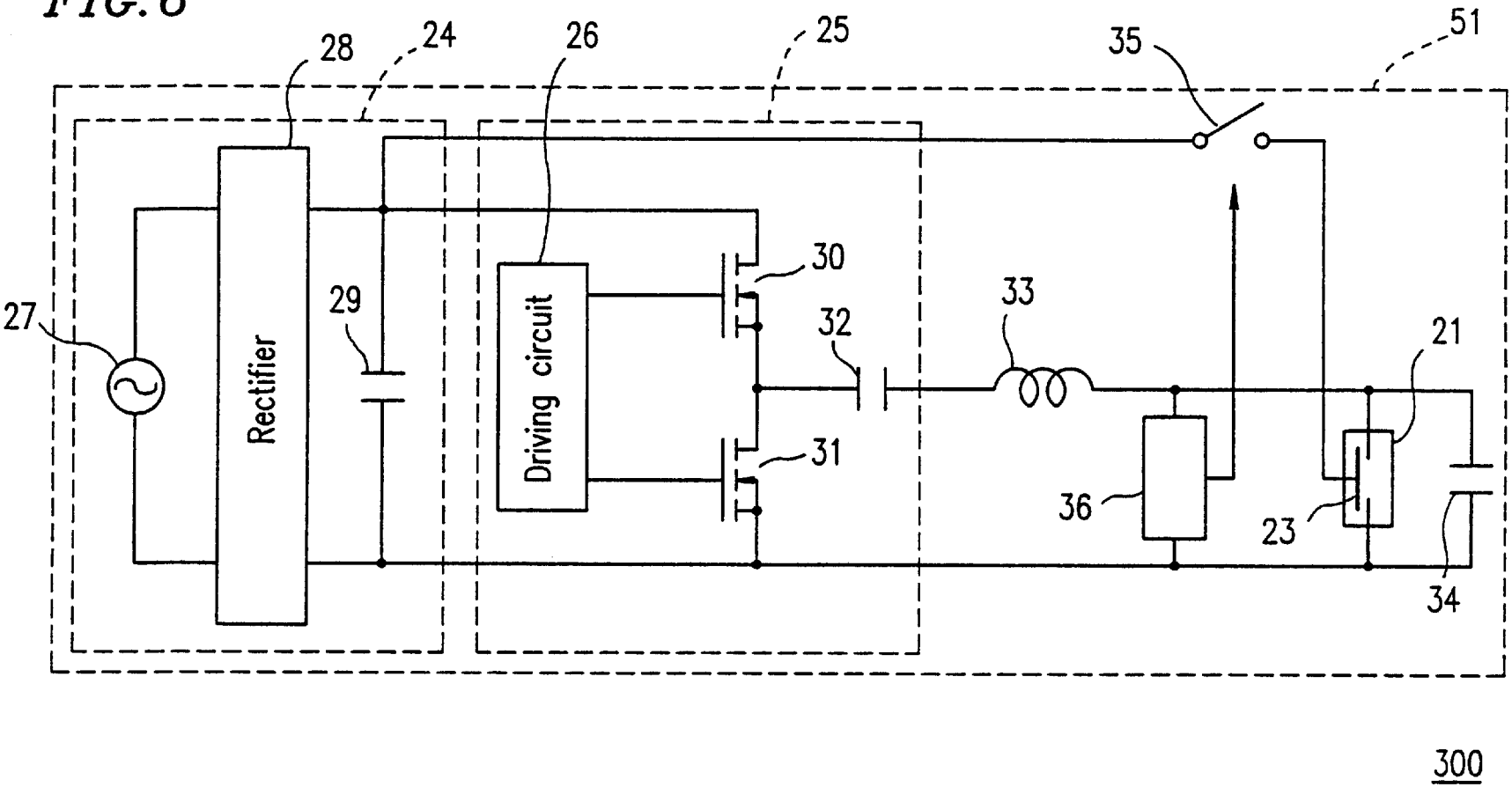
FIG. 6 is a schematic view of a fluorescent lamp operating apparatus in a third example according to the present invention.

FIG. 6 is a schematic view of a fluorescent lamp operating apparatus 300 in a third example according to the present invention. Identical elements previously discussed with respect to the second example bear identical reference numerals and the detailed descriptions thereof will be omitted.

The fluorescent lamp operating apparatus 300 is different from the fluorescent lamp operating apparatus 200 in including an operating condition detection circuit 36 for detecting an operating condition of the fluorescent lamp 21 and a switching device 35 to be turned ON or OFF based on a signal from the operating condition detection circuit 36 so that a potential is applied to the light-transmissive conductive film 23 through the switching device 35. A ballast circuit in this example is represented by reference numeral 51.

The operating condition detection circuit 36 detects an operating condition of the fluorescent lamp 21. When the fluorescent lamp 21 is in a rated operating condition, the operating condition detection circuit 36 supplies an ON signal to the switching device 35; and when the fluorescent lamp 21 is in a starting condition before being put into the rated operating condition, the operating condition detection circuit 36 supplies an OFF signal to the switching device 35. The state of the fluorescent lamp 21, i.e., whether the fluorescent lamp 21 is in the starting condition or in the rated operating condition is easily determined by, for example, detecting a lamp voltage of the fluorescent lamp 21.

The fluorescent lamp operating apparatus 300 having the above-described structure operates in, for example, the following manner.

First, the operation upon starting the fluorescent lamp 21 will be described.

Upon starting the fluorescent lamp 21, an OFF signal is supplied from the operating condition detection circuit 36 and thus the switching device 35 is OFF. Thus, the light-transmissive conductive film 23 is not provided with any potential and acts as a conductor located in the vicinity of the fluorescent lamp 21. It is generally known that the breakdown voltage of a fluorescent lamp is lowered by disposing a conductor in the vicinity of the fluorescent lamp. In the third example, the light-transmissive conductive film 23 acts as a start assistance device for lowering the breakdown voltage of the fluorescent lamp 21. Accordingly, the fluorescent lamp 21 starts discharge at a breakdown voltage lower than the breakdown voltage in the first and second examples.

When the fluorescent lamp 21 is put into the rated operating condition, the operating condition detection circuit 36 supplies an ON signal to the switching device 35 so as to turn ON the switching device 35. Then, an output potential of the high potential output of the DC power supply circuit 24 is applied to the light-transmissive conductive film 23. Thereafter, the mercury ion density in the glass tube 41 is distributed in the same manner as described in the previous examples with reference to FIG. 3. Thus, the reaction between the mercury and both of the phosphor layer 42 and the glass tube 41 is suppressed, thereby restricting the deterioration of the phosphor layer 42 and the loss of the mercury.

As described above, the fluorescent lamp operating apparatus 300 in the third example according to the present invention includes the fluorescent lamp 21, the ballast circuit 51 for starting the fluorescent lamp 21, the light-transmissive conductive film 23 acting as a potential application member disposed so as to enclose the discharge plasma generated in the fluorescent lamp 21, the operating condition detection circuit 36 for detecting an operating condition of the fluorescent lamp 21, and a switching device 35 to be turned ON or OFF based on a signal from the operating condition detection circuit 36. The high potential output of the DC power supply circuit 24 is connected to the light-transmissive conductive film 23 through the switching device 35. Upon starting the fluorescent lamp 21, the switching device 35 is turned OFF in order to cause the light-transmissive conductive film 23 to act as a start assistance device. Accordingly, the breakdown voltage of the fluorescent lamp 21 is lowered and thus the fluorescent lamp 21 is started more easily.

Since components having a sufficiently low withstand voltage can be used and the insulating distance between components can be shortened, the size of the fluorescent lamp operating apparatus 300 can be reduced. Furthermore, when the fluorescent lamp 21 is in the rated operating condition, the switching device 35 is turned ON to supply the light-transmissive conductive film 23 with a potential, so that the light-transmissive conductive film 23 acts as a potential application member. In this manner, the lumen maintenance factor is improved and the life of the fluorescent lamp 21 is extended by preventing the deterioration of the phosphor layer 42 and the loss of mercury without using the protective film as is required in the conventional operating apparatuses.

EXAMPLE 4

Figure 7:
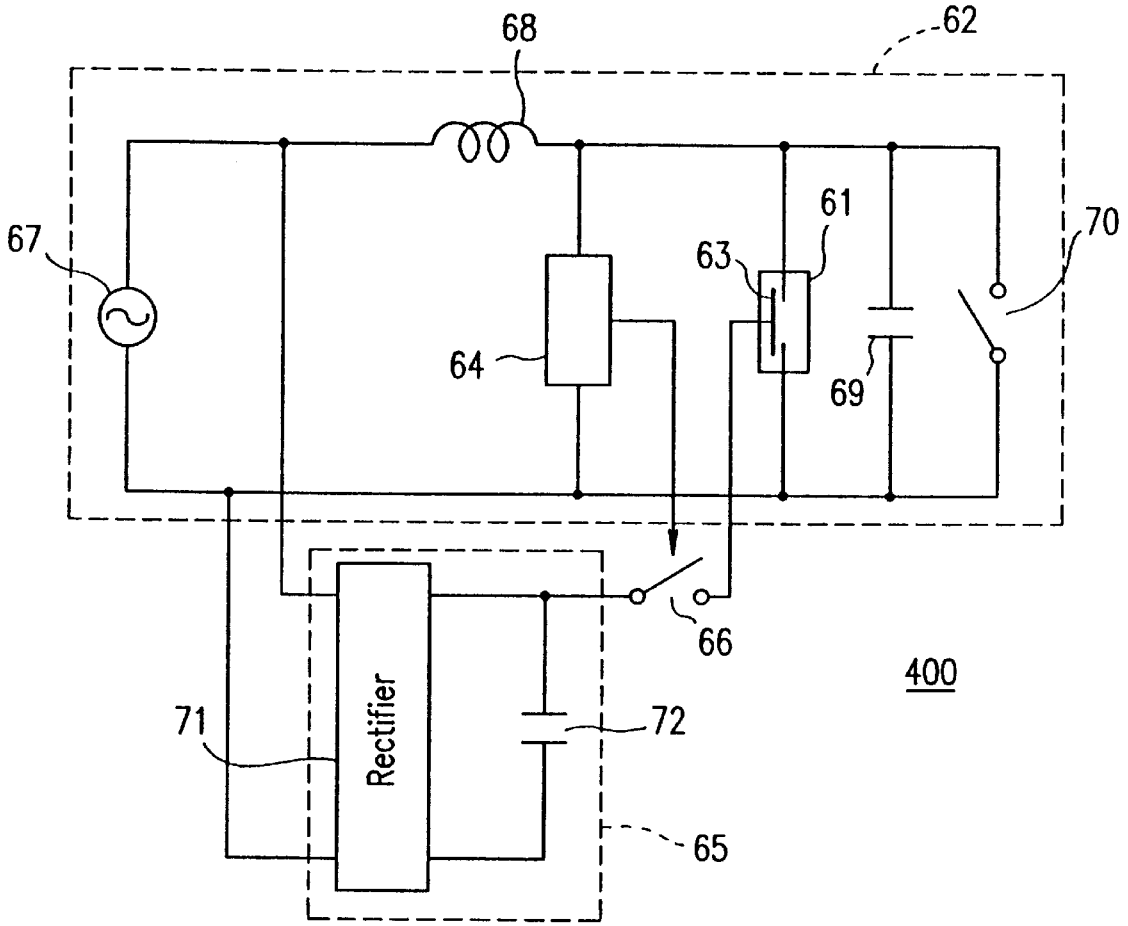
FIG. 7 is a schematic view of a fluorescent lamp operating apparatus in a fourth example according to the present invention.

FIG. 7 is a schematic view of a fluorescent lamp operating apparatus 400 in a fourth example according to the present invention.

The fluorescent lamp operating apparatus 400 in FIG. 7 includes a fluorescent lamp 61, a ballast circuit 62 for starting the fluorescent lamp 61, a thin light-transmissive conductive film 63 acting as a potential application member disposed so as to enclose discharge plasma generated in the fluorescent lamp 61, an operating condition detection circuit 64 for detecting an operating condition of the fluorescent lamp 61, a potential application circuit 65 for applying a potential to the light-transmissive conductive film 63 which is higher than that of the discharge plasma, and a switching device 66. One end of the switching device 66 is connected to the light-transmissive conductive film 63, and the other end of the switching device 66 is connected to the fluorescent lamp 61. Based on a signal from the operating condition detection circuit 64, the switching device 66 is turned ON when the fluorescent lamp 61 is in the rated operating condition and turned OFF at the start of the fluorescent lamp 61.

The ballast circuit 62 includes a commercial AC power supply 67, a choke coil 68 as a current limiting element, a capacitor 69 for preventing noise, and a starter 70. Whereas a fluorescent lamp is operated at a high frequency of several tens of kilohertz in the first, second and third examples, the fluorescent lamp 61 is operated at a commercial AC frequency of 50 Hz or 60 Hz in the fourth example.

The potential application circuit 65 rectifies and smooths an input commercial AC voltage by a rectifier 71 and a capacitor 72. At this point, the output potential from the high potential output of the potential application circuit 65 corresponds to the highest potential of the commercial AC power supply 67, which is higher than the potential of the discharge plasma generated in the fluorescent lamp 61. The fluorescent lamp 61, the light-transmissive conductive film 63, the operating condition detection circuit 64 and the switching device 66 are identical with the corresponding elements thereto in the third example and thus will not be described in detail.

The fluorescent lamp operating apparatus 400 having the above-described structure operates in, for example, the following manner.

First, the operation upon starting the fluorescent lamp 61 will be described.

Upon starting the fluorescent lamp 61, an OFF signal is supplied from the operating condition detection circuit 64 and thus the switching device 66 is OFF. Thus, the light-transmissive conductive film 63 is not provided with any potential and acts as a start assistance device for lowering the breakdown voltage of the fluorescent lamp 61. Accordingly, the fluorescent lamp 61 can be started at a sufficiently low breakdown voltage. When the starter 70 is closed, a preheating current flows through the electrodes at both ends of the fluorescent lamp 61. When the electrodes are sufficiently heated, thermionic radiation and local discharge of mercury occur at each of the electrodes. When the starter 70 is opened, a high voltage is induced to the choke coil 68 and the induced high voltage is applied to the fluorescent lamp 61, thereby starting discharge. After the fluorescent lamp 61 is started, the current is limited by the choke coil 68 and thus the fluorescent lamp 61 maintains a stable operation.

When the fluorescent lamp 61 is put into the rated operating condition, the operating condition detection circuit 64 supplies an ON signal to the switching device 66 so as to turn ON the switching device 66. Then, an output potential of the potential application circuit 65 is applied to the light-transmissive conductive film 63. Thereafter, the mercury ion density in the glass tube 61 is distributed in the same manner as described in the second and third examples. Thus, the reaction between the mercury and both of the phosphor layer (not shown) and the glass tube 61 is suppressed, thereby restricting the deterioration of the phosphor layer and the loss of the mercury.

As described above, the fluorescent lamp operating apparatus 400 in the fourth example according to the present invention includes the fluorescent lamp 61, the ballast circuit 62 for starting the fluorescent lamp 61 at a commercial frequency of 50 Hz or 60 Hz, the light-transmissive conductive film 63 acting as a potential application member disposed so as to enclose discharge plasma generated in the fluorescent lamp 61, and the operating condition detection circuit 64 for detecting an operating condition of the fluorescent lamp 61, and the switching device 66 to be turned ON or OFF based on a signal from the operating condition detection circuit 64. The output potential of the potential application circuit 65 is connected to the light-transmissive conductive film 63 through the switching device 66. Upon starting the fluorescent lamp 61, the switching device 66 is turned OFF in order to cause the light-transmissive conductive film 63 to act as a start assistance device. Accordingly, the breakdown voltage of the fluorescent lamp 61 is lowered and thus the fluorescent lamp 61 is started more easily.

Since components having a sufficiently low withstand voltage can be used and the insulating distance between components can be shortened, the size of the fluorescent lamp operating apparatus 400 can be reduced. Furthermore, when the fluorescent lamp 61 is in the rated operating condition, the switching device 66 is turned ON to supply the light-transmissive conductive film 63 with a potential, so that the light-transmissive conductive film 63 acts as a potential application member. In this manner, the lumen maintenance factor is improved and the life of the fluorescent lamp 61 is extended by preventing the deterioration of the phosphor layer and the loss of mercury without using the protective film as is required in the conventional operating apparatuses.

Moreover, the use of a commercial frequency ballast circuit improves the start-up characteristic of the fluorescent lamp 61 with a simple structure and also extends the life of the fluorescent lamp 61.

In the first through fourth examples, a light-transmissive conductive film provided on the fluorescent lamp is used as the potential application member. The potential application member need not be a thin film and can be any member (for example, a reflector) which allows a potential to be applied thereto and can be located or is generally located so as to enclose the discharge plasma.

The light-transmissive conductive film is provided on an outer surface of the fluorescent lamp in the first example and is provided on an inner surface of the fluorescent lamp in the second, third and fourth examples. The same effect is achieved in both cases. Accordingly, the light-transmissive conductive film can be provided on an inner surface of the fluorescent lamp in the first example and can be provided on an outer surface of the fluorescent lamp in the second through fourth examples.

The potential application member need not be light-transmissive, although a higher light utilization factor is obtained when a potential application member is light-transmissive. The potential application member need not be conductive, although a conductive member is also usable as a start assistance conductor and thus is preferred.

Figure 8:
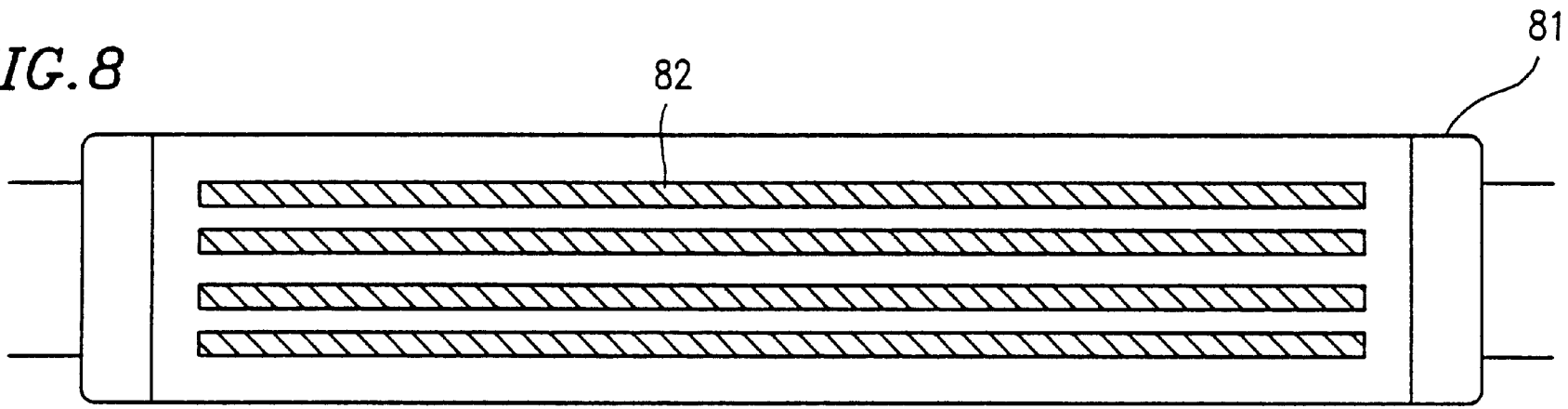
FIG. 8 is a schematic view of a fluorescent lamp having a striped potential application member (light-transmissive conductive film)
Figure 9:
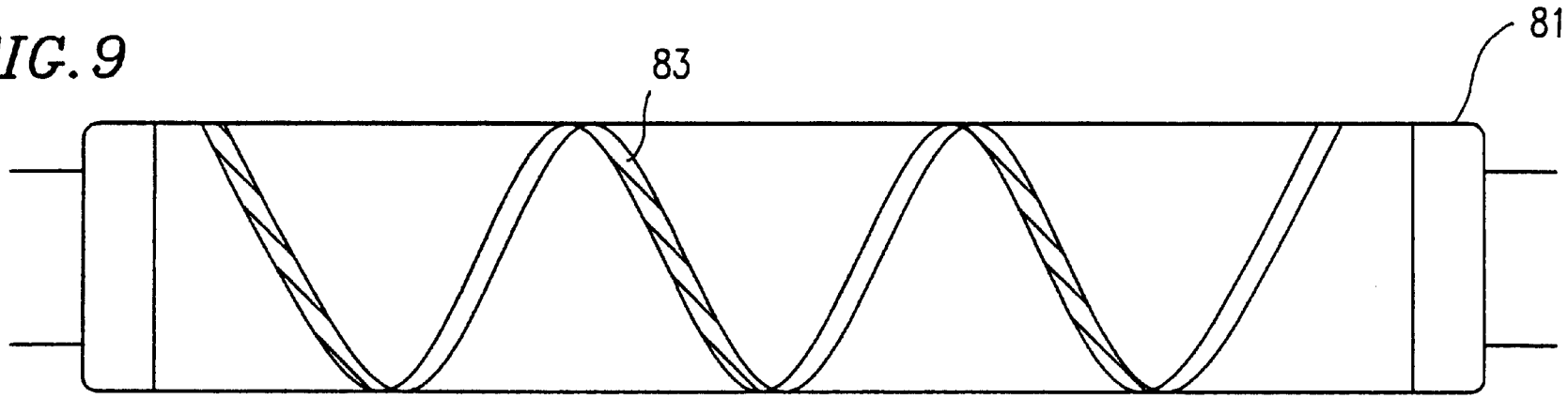
FIG. 9 is a schematic view of a fluorescent lamp having a spiral potential application member (light-transmissive conductive film)
Figure 10:
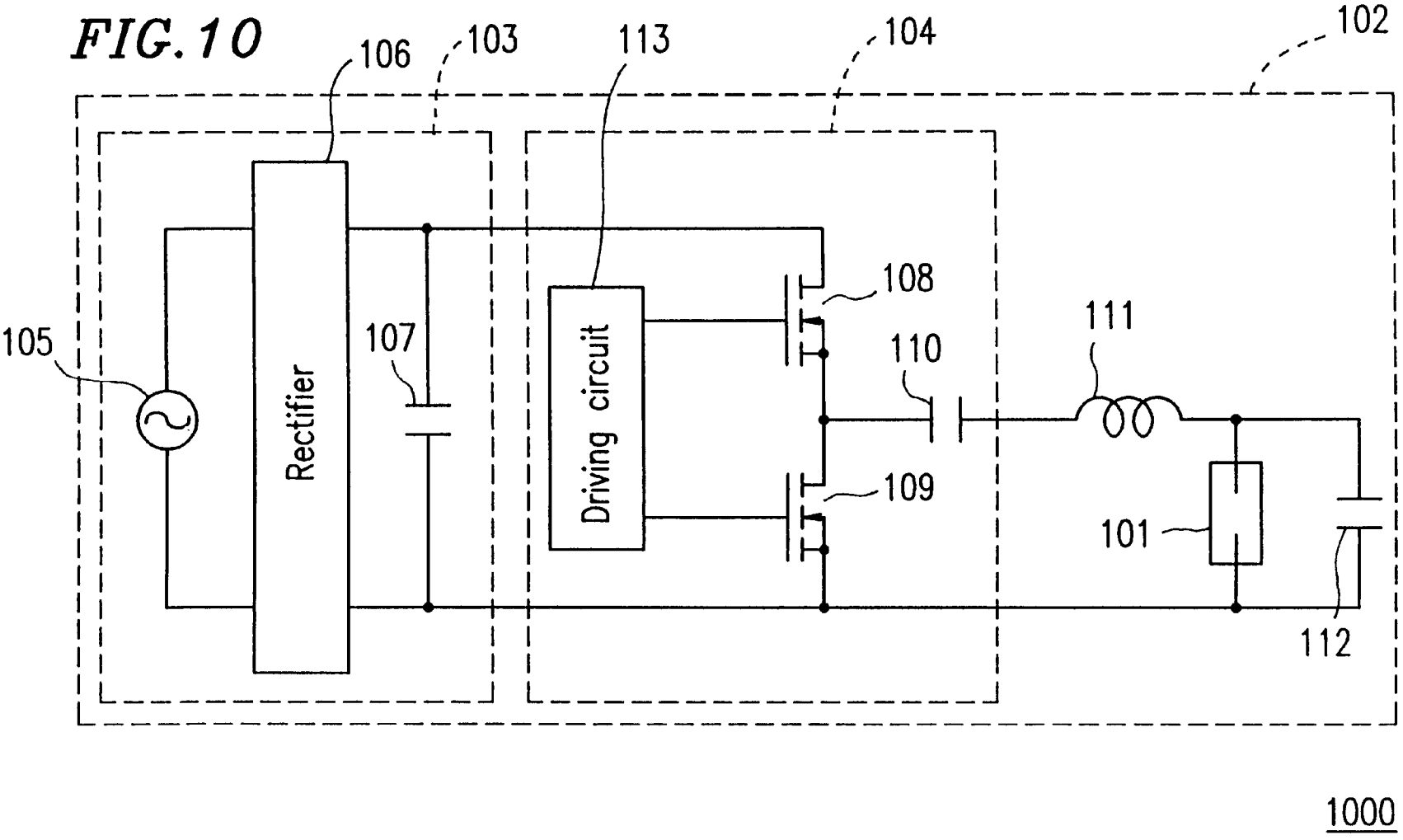
FIG. 10 is a schematic view of a conventional fluorescent lamp operating apparatus.
Figures 11A, 11B:
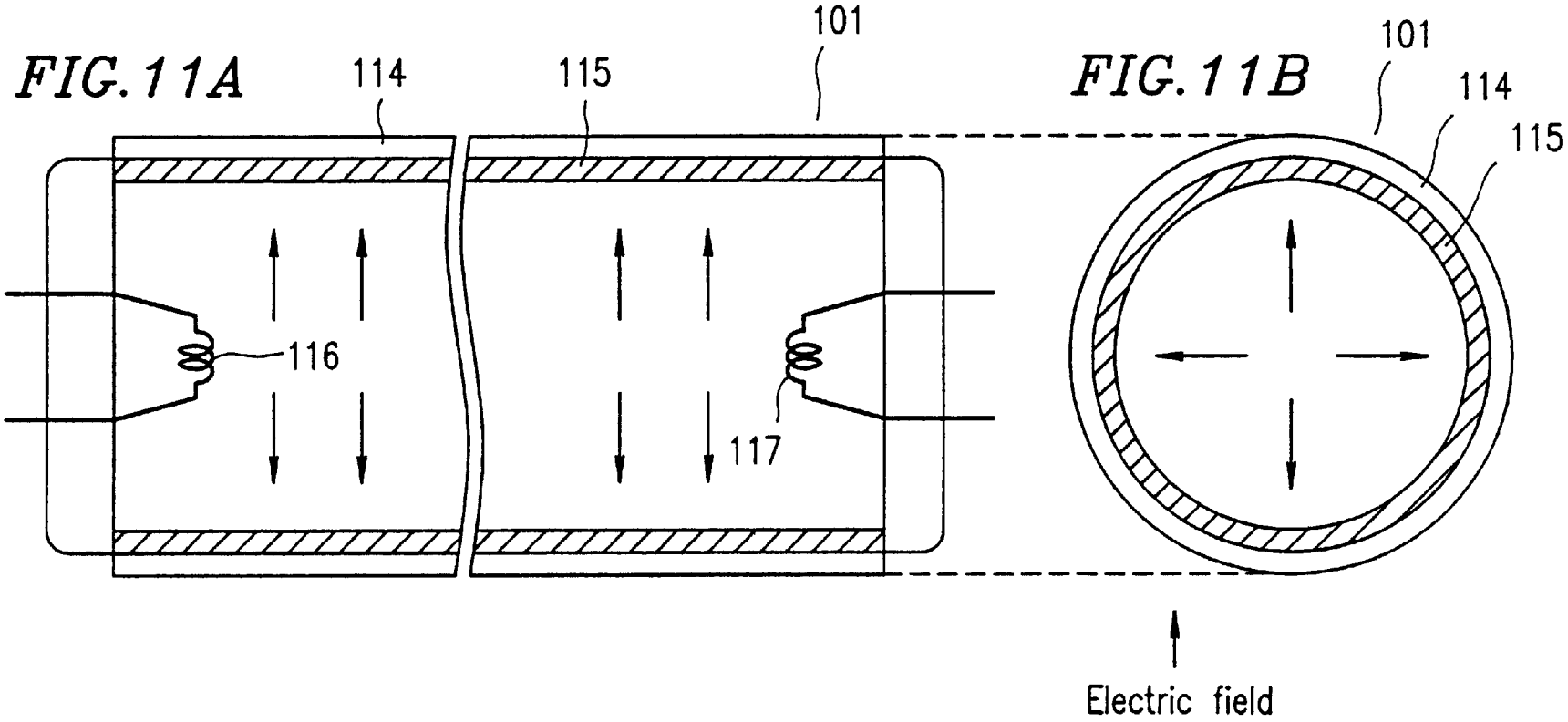
FIG. 11A is a cross-sectional view of the fluorescent lamp of the fluorescent lamp operating apparatus shown in FIG. 10 along a longitudinal axis thereof.
FIG. 11B is a cross-sectional view of the fluorescent lamp shown in FIG. 10 in a radial direction thereof.
Figure 12:
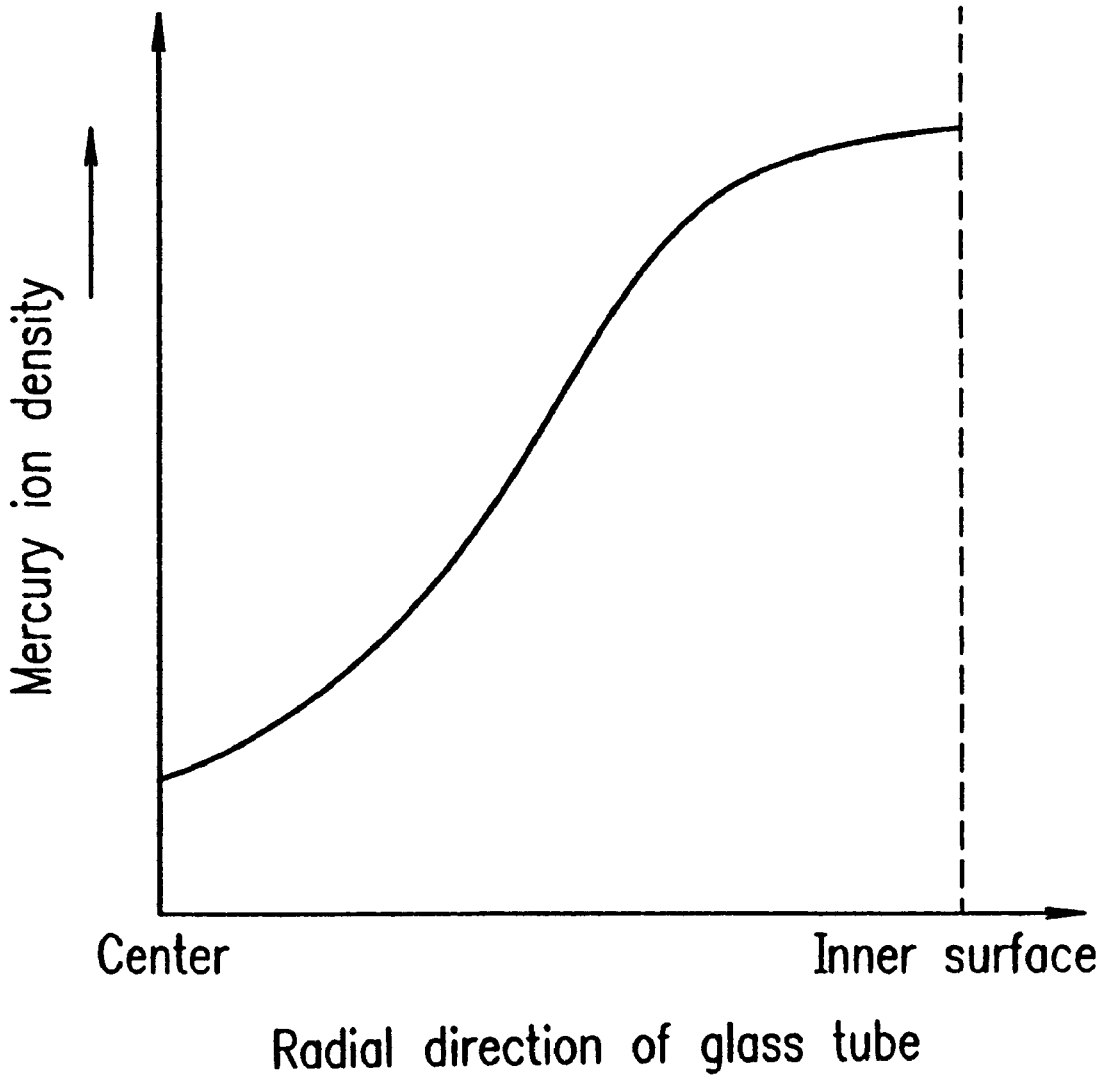
FIG. 12 is a graph illustrating distribution of mercury ion density in a radial direction of a glass tube of the conventional fluorescent lamp shown in FIG. 10.

In the first through fourth examples, a light-transmissive conductive film as a potential application member is provided so as to enclose the discharge plasma substantially entirely. The present invention is not limited to such a form of potential application member. The potential application member can be in other forms as long as a prescribed electric field in a direction from the inner surface to the center of the glass tube is generated. For example, a striped potential application member 82 can be formed on a fluorescent lamp 81 as shown in FIG. 8, or a spiral potential application member 83 can be formed on the fluorescent lamp 81 as shown in FIG. 9.

Even when the light-transmissive conductive film as the potential application member is provided on an outer surface of the glass tube as in the first example, the safety is assured by, for example, an appropriate insulation covering is provided on the light-transmissive conductive film.

In the first through third examples, the ballast circuit can have any other structure which starts the fluorescent lamp at a high frequency. The DC power supply circuit can have any other structure which provides a DC output. The inverter circuit can have any other structure which converts an output from the DC power supply circuit to an AC output. In the fourth example, the ballast circuit can have any other structure which starts the fluorescent lamp at a commercial frequency.

In the first example, a voltage doubler rectifier is used for configuring the potential application circuit. The potential application circuit can have any other structure which outputs a potential higher than that of the discharge plasma.

In the fourth example, the potential application circuit includes a rectifier and a capacitor. The potential application circuit can have any other structure which outputs a potential higher than that of the discharge plasma. A potential is applied to the light-transmissive conductive film through the switching device. Alternatively, a potential can be directly applied from the potential application circuit. In such a case, however, the effect of lowering the breakdown voltage is not obtained.

In general, the potential of the discharge plasma has a gradient between electrodes. Therefore, different potions of the electric field generated in different portions of the discharge plasma in the glass tube are different in strength. However, in the case where the fluorescent lamp is operated by an AC current, an average strength over time of each portion of the electric field is substantially the same regardless of the portion in the glass tube. Accordingly, the overall life of the fluorescent lamp is extended.

As described above, according to the present invention, a fluorescent lamp, a ballast circuit for starting the fluorescent lamp, a potential application member disposed so as to enclose discharge plasma generated in the fluorescent lamp, and a potential application circuit for applying a potential to the potential application member which is higher than that of the discharge plasma are provided, and the potential application member and the potential application circuit are connected to each other so as to raise the potential of the potential application member to a level higher than that of the discharge plasma. Thus, an electric field in a direction from the inner surface to the center of the glass tube is generated. Due to thus generated electric field, the mercury ion density in the vicinity of the inner surface of the glass tube is lower than at the center of the glass tube, so that the reaction between the mercury and both of the phosphor and the glass tube is suppressed. In consequence, the deterioration of the phosphor and the loss of the mercury are prevented, and improvement of the lumen maintenance factor and extension of life of the fluorescent lamp are realized.

In the case where the potential application member and the potential application circuit are connected to each other through the switching device and the switching device is turned OFF at the start of the fluorescent lamp, the potential application member acts as a start assistance device. Thus, the fluorescent lamp can be started relatively easily.

Various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed is:

1. A fluorescent lamp operating apparatus, comprising:

a fluorescent lamp including a glass tube coated with a phosphor and having at least mercury sealed therein, a ballast circuit connected to the fluorescent lamp for starting the fluorescent lamp;

a potential application member disposed so as to at least partially surround a discharge plasma generated in the fluorescent lamp; and a potential application circuit for applying a potential to the potential application member, wherein the potential applied to the potential application member is higher than a potential of the discharge plasma, thereby generating an electric field in a direction from an inner surface of the glass tube toward a center of the glass tube, such that a depletion of the mercury is suppressed.

2. A fluorescent lamp operating apparatus according to claim 1, wherein the potential application member is provided in the glass tube.

3. A fluorescent lamp operating apparatus according to claim 1, wherein the potential application member is a thin film provided on the glass tube.

4. A fluorescent lamp operating apparatus according to claim 3, wherein the thin film is light-transmissive.

5. A fluorescent lamp operating apparatus according to claim 3, wherein the thin film is striped.

6. A fluorescent lamp operating apparatus according to claim 2, wherein the thin film is spiral.

7. A fluorescent lamp operating apparatus according to claim 1, wherein the potential application member is conductive.

8. A fluorescent lamp operating apparatus according to claim 7, wherein the potential applied to the potential application member is higher than the potential of the discharge plasma at least in a period in which the fluorescent lamp is in a rated operating condition.

9. A fluorescent lamp operating apparatus according to claim 1, further comprising a switching device for controlling the potential applied to the potential application member.

10. A fluorescent lamp operating apparatus according to claim 9, wherein the switching device is turned ON while the fluorescent lamp is in a starting period and turned OFF while the fluorescent lamp is in a rated operating condition.

11. A fluorescent lamp operating apparatus according to claim 1, wherein the ballast circuit further comprises a DC power supply circuit for supplying a power to the fluorescent lamp and applying the potential to the potential application member.

12. A fluorescent lamp operating apparatus, comprising:

a fluorescent lamp including a glass tube coated with a phosphor and having at least mercury sealed therein, a ballast circuit connected to the fluorescent lamp for starting the fluorescent lamp;

a potential application member disposed so as to at least partially surround a discharge plasma generated in the fluorescent lamp; and a potential application circuit included in the ballast circuit for applying a potential to the potential application member, wherein the potential applied to the potential application member is higher than a potential of the discharge plasma, thereby generating an electric field in a direction from an inner surface of the glass tube toward a center of the glass tube, such that a depletion of the mercury is suppressed.

13. A fluorescent lamp operating apparatus according to claim 12, wherein the ballast circuit further comprises a DC power supply circuit for supplying a power to the fluorescent lamp and applying the potential to the potential application member.

* * * * *

UNITED STATES PATENT AND TRADEMARK OFFICE

CERTIFICATE OF CORRECTION

PATENT NO. : 6,107,757
DATED : August 22, 2000
INVENTOR(S) : Kominami et al.

It is certified that error appears in the above-identified patent and that said Letters Patent is hereby corrected as shown below:

Title page,
Please add:
-- Field [30], Foreign Application Priority Data
March 17, 1997 [JP] Japan 9-062662 --

Column 13,
"Claim 2" should read -- claim 3 --.

Signed and Sealed this

Twenty-fifth Day of September, 2001

*Attest:*

Nicholas P. Godici

NICHOLAS P. GODICI
*Acting Director of the United States Patent and Trademark Office*

*Attesting Officer*